US006565665B2

(12) United States Patent
Altschuler

(10) Patent No.: US 6,565,665 B2
(45) Date of Patent: May 20, 2003

(54) LICE COMB CLEANING DEVICE

(76) Inventor: Deborah Z. Altschuler, 110 Leubert Rd., Newton, MA (US) 02159

( * ) Notice: Subject to any disclaimer, the term of this patent is extended or adjusted under 35 U.S.C. 154(b) by 0 days.

(21) Appl. No.: 09/575,639

(22) Filed: May 22, 2000

(65) Prior Publication Data

US 2003/0070243 A1 Apr. 17, 2003

(51) Int. Cl.[7] ..... B08B 1/00; A45D 24/44
(52) U.S. Cl. ..... 134/6; 15/104.5
(58) Field of Search ..... 15/104.5; 132/323; 134/6

(56) References Cited

U.S. PATENT DOCUMENTS 3,642,011 A * 2/1972 Thompson
3,871,392 A * 3/1975 Thomas
D251,074 S * 2/1979 Schiff
5,094,256 A * 3/1992 Barth
5,127,415 A * 7/1992 Preciutti
5,388,600 A * 2/1995 Hart
5,931,171 A * 8/1999 Landis et al.
6,102,051 A * 8/2000 Neves

* cited by examiner

*Primary Examiner*—Randall E. Chin
(74) *Attorney, Agent, or Firm*—Choate, Hall & Stewart

(57) ABSTRACT

Lice comb cleaning tool. The tool includes a handle, a pair of spaced-apart arms depending from the handle and an elongate member supported at distal ends of the pair of arms. The elongate member has a diameter selected for an interference fit between tines of a lice comb. It is preferred that the elongate member be unwaxed dental floss.

7 Claims, 2 Drawing Sheets

LICE COMB CLEANING DEVICE

BACKGROUND OF THE INVENTION

Head lice are reddish-brown wingless insects about the size of a sesame seed. These insects infest hair. Once in hair, the head lice lay eggs which are known as nits. The nits are small greyish-white oval-shaped eggs glued at an angle to the side of a hair shaft. Head lice are mainly transmitted by head-to-head contact but can also be spread through the sharing of personal articles.

Whether or not one chooses to use a pesticidal lice treatment or not, all of the nits (lice eggs) and lice must be manually removed. This manual removal is often accomplished with a lice comb having multiple, closely spaced tines which will remove the lice and nits as it passes through hair. One such highly effective lice or nit comb is the LiceMeister™ available from the National Pediculosis Association of Newton, Mass. See also, U.S. Ser. No. 09/054,211 filed Apr. 2, 1998 entitled "An Apparatus and Method for Pest Removal from Hair and Fur," and now pending, the contents of which are incorporated herein by reference.

It is important that nit combs be cleaned preferably between successive passings through the hair and certainly between usage so that lice and nits are not spread inadvertently. The present invention thus has as its object a tool for cleaning lice and nit combs.

SUMMARY OF THE INVENTION

According to the invention, a lice comb cleaning tool includes a handle, a pair of space-apart arms depending from the handle and an elongate member supported at distal ends of the pair of arms. The elongate member has a diameter selected for an interference fit between tines of a lice comb. It is preferred that the arms have a length that will extend more than halfway across the lice comb for ease of use. It is also preferred that the elongate member be made of a deformable fibrous material such as, for example, unwaxed dental floss. This material may be secured in a hole in the distal end of each of the arms.

DESCRIPTION OF THE PREFERRED EMBODIMENT

Figure 1:
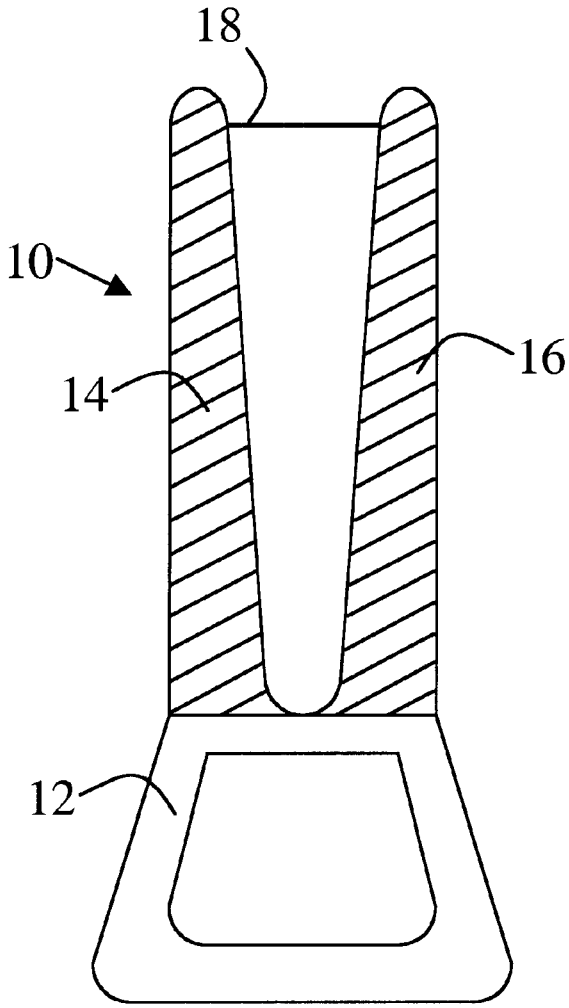
FIG. 1 is a plan view of the lice comb cleaning tool of the invention.
Figure 2:
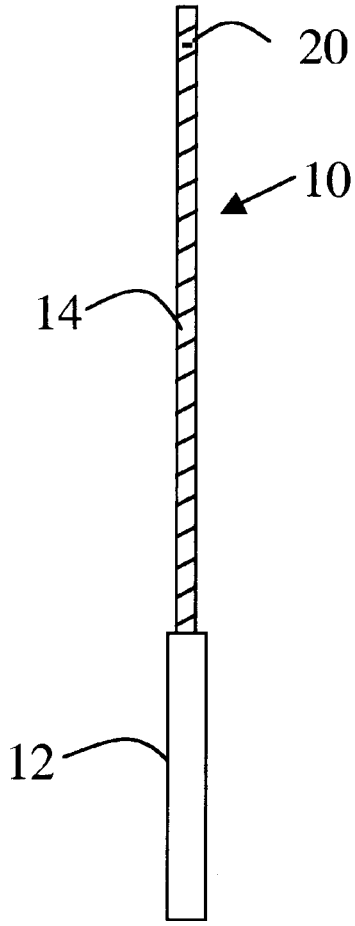
FIG. 2 is a side view of the tool of the invention.

With reference first to FIGS. 1 and 2, a lice comb cleaning tool 10 includes a handle portion 12 from which depend arms 14 and 16 which are spaced apart as shown in FIG. 1. An elongate member 18 is supported at distal ends of the arms 14 and 16. As shown in FIG. 2, a hole 20 passes through the distal ends of the arms 14 and 16. The holes 20 may be used to support the elongate member 18.

It is preferred that the elongate member 18 be a deformable fibrous material such as, for example, unwaxed dental floss. It should be recognized that other strong elongate materials could be used. Fibrous material such as unwaxed dental floss is passed through the holes 20 and secured as by tying a knot or by any other means. A suitable overall length for the tool 10 is approximately 60 mm with a width of approximately 22 mm.

Figure 3:
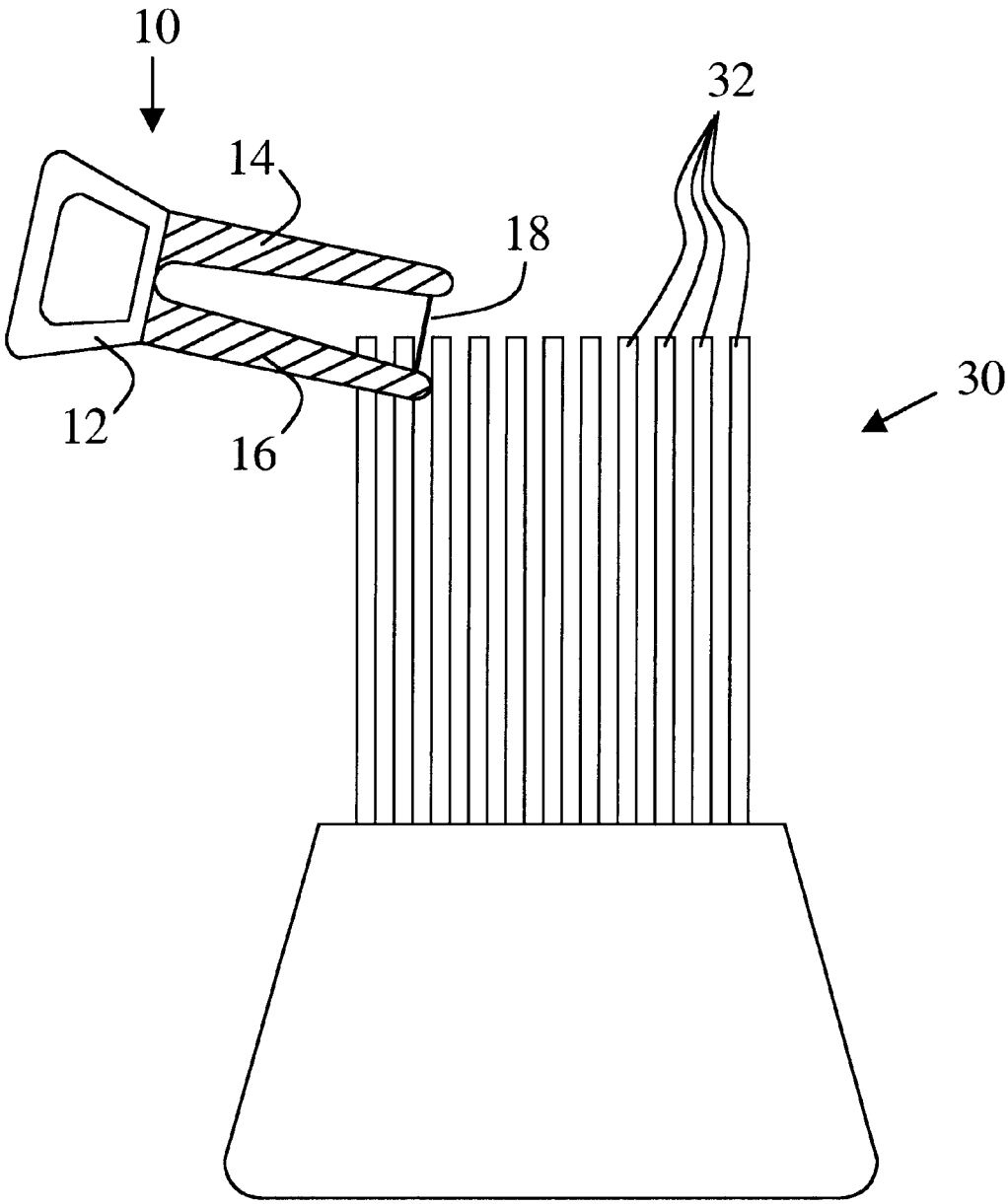
FIG. 3 is a perspective view of the tool of the invention being used in conjunction with a lice comb.

FIG. 3 shows the tool 10 cooperating with an exemplary lice comb 30 to clean the comb 30. The spaces between tines 32 are exaggerated for clarity. It is important that the elongate member 18 such as unwaxed dental floss have a diameter which provides an interference fit between the tines 32. By interference fit is meant that the elongate member 18 will contact snuggly both adjacent tines 32 as it passes between them. In this way, lice and nits on the comb 30 will be removed as the elongate member 18 of the tool 10 is passed through all of the adjacent pairs of tines 32. It is also preferred that the arms 14 and 16 be sufficiently long so that at least approximately half of the tines 32 may be cleaned from one side of the comb 30. Thereafter, the comb 30 may be turned around so that the other tines may be cleaned.

While it is contemplated that the elongate member 18 can be replaceable, it is preferred that the tool 10 be discarded after use to prevent recontamination of a comb upon the next usage of the tool 10. It is also contemplated that the tool 10 and/or the comb 30 can be sent to a biological testing lab after usage to culture materials that may be present for the purpose of diagnosing infections of the scalp beyond just headlice infestations.

The tool 10 may be made from any suitable material such as metals or plastics. Because the tool 10 is designed to be disposable, it is preferred that the tool 10 be made of plastic, for example, an injection molded plastic.

It is recognized that modifications and variations of the present invention will occur to those skilled in the art and it is intended that all such modifications and variations be included within the scope of the appended claims.

What is claimed is:

1. A method for cleaning a lice comb, comprising:

supporting an elongate member at distal ends of a pair of spaced-apart arms attached to a handle;

sliding said elongate member between a pair of tines of said lice comb, wherein said elongate member forms an interference fit with said pair of tines.

2. The method of claim 1, further comprising:

repeating said sliding step between multiple pairs of tines of said lice comb.

3. The method of claim 1, further comprising:

turning said lice comb around and repeating said sliding step.

4. The method of claim 1, wherein the elongate member is deformable.

5. The method of claim 4, wherein the elongate member is dental floss.

6. The method of claim 5, wherein the dental floss is unwaxed.

7. The method of claim 1, wherein the distal ends of the arms include a hole supporting the elongate member.

* * * * *